US009058001B2

(12) United States Patent
Sato et al.

(10) Patent No.: US 9,058,001 B2
(45) Date of Patent: Jun. 16, 2015

(54) IMAGE FORMING APPARATUS

(71) Applicant: FUJI XEROX CO., LTD., Minato-ku, Tokyo (JP)

(72) Inventors: Narumasa Sato, Kanagawa (JP); Eiji Nakai, Kanagawa (JP); Katsuyuki Kitajima, Kanagawa (JP); Makoto Kamisaki, Kanagawa (JP); Toyofumi Inoue, Kanagawa (JP); Takafumi Koide, Kanagawa (JP); Masataka Kuribayashi, Kanagawa (JP); Yoshinari Ueno, Kanagawa (JP); Yoshifumi Eri, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 47 days.

(21) Appl. No.: 13/935,844

(22) Filed: Jul. 5, 2013

(65) Prior Publication Data

US 2014/0112677 A1 Apr. 24, 2014

(30) Foreign Application Priority Data

Oct. 24, 2012 (JP) ..... 2012-234322

(51) Int. Cl.
*G03G 15/16* (2006.01)
*G03G 15/00* (2006.01)

(52) U.S. Cl.
CPC ..... *G03G 15/5029* (2013.01); *G03G 15/657* (2013.01); *G03G 2215/00949* (2013.01)

(58) Field of Classification Search
CPC ..... G03G 15/1675; G03G 15/0189; G03G 15/1605; G03G 15/16
USPC ..... 399/66
See application file for complete search history.

(56) References Cited

U.S. PATENT DOCUMENTS

2005/0269759 A1* 12/2005 Sano et al. ..... 271/3.01
2007/0041762 A1 2/2007 Ishida et al.
2008/0074453 A1* 3/2008 Furukawa ..... 347/14

(Continued)

FOREIGN PATENT DOCUMENTS

JP 2007-086726 A 4/2007
JP 2007-171573 A 7/2007

OTHER PUBLICATIONS

Machine translation of Nagai, JP 2010-041430 A, publication date: Feb. 18, 2010.*

(Continued)

*Primary Examiner* — Walter L Lindsay, Jr.
*Assistant Examiner* — Frederick Wenderoth
(74) *Attorney, Agent, or Firm* — Sughrue Mion, PLLC

(57) ABSTRACT

An image forming apparatus includes a toner image forming unit that forms and continuously transfers a toner image based on image data onto a transported sheet from the front to the rear in a sheet transport direction as the sheet is transported, a fixing unit positioned downstream of the toner image forming unit in the transport direction and that fixes the transferred toner image onto the sheet, an image determining unit that determines whether the formed toner image is a scattering toner image that causes toner scattering during the transfer, and a speed controlling unit that controls, when it is determined that the toner image is a scattering toner image, a transport speed of the sheet and a transfer speed of the toner image to the sheet such that the speeds are slower than those when it is determined that the toner image is not a scattering toner image.

4 Claims, 5 Drawing Sheets

(56) References Cited

U.S. PATENT DOCUMENTS

| | | | | |
|---|---|---|---|---|
| 2011/0058831 | A1* | 3/2011 | Usami et al. | 399/46 |
| 2012/0045237 | A1* | 2/2012 | Aoki et al. | 399/66 |
| 2012/0072015 | A1* | 3/2012 | Takahashi | 700/229 |

OTHER PUBLICATIONS

Machine translation of Nagai, JP 2010-041430 A II, publication date: Feb. 18, 2010.*

* cited by examiner

IMAGE FORMING APPARATUS

CROSS-REFERENCE TO RELATED APPLICATIONS

This application is based on and claims priority under 35 USC 119 from Japanese Patent Application No. 2012-234322 filed Oct. 24, 2012.

BACKGROUND

Technical Field

The present invention relates to an image forming apparatus.

SUMMARY

According to an aspect of the invention, there is provided an image forming apparatus including a toner image forming unit that forms a toner image on the basis of image data and transfers in a continuous manner the toner image onto a sheet, which is being transported, from a front end of the sheet to a rear end of the sheet in a transport direction of the sheet as the sheet is transported, a fixing unit that is positioned further downstream than the toner image forming unit in the transport direction of the sheet and that fixes the toner image, which has been transferred to the sheet by the toner image forming unit, onto the sheet, an image determining unit that determines whether or not the toner image that is formed by the toner image forming unit is a scattering toner image that causes scattering of toner when the toner image is transferred to the sheet, and a speed controlling unit that controls, in the case where it is determined that the toner image is a scattering toner image by the image determining unit, a transport speed at which the sheet is transported by the toner image forming unit and a transfer speed at which the toner image is transferred to the sheet such that the transport speed and the transfer speed are slower than the transport speed and the transfer speed in the case where it is determined that the toner image is not a scattering toner image.

BRIEF DESCRIPTION OF THE DRAWINGS

An exemplary embodiment of the present invention will be described in detail based on the following figures, wherein.

DETAILED DESCRIPTION

An exemplary embodiment of the present invention will now be described below.

Figure 1:
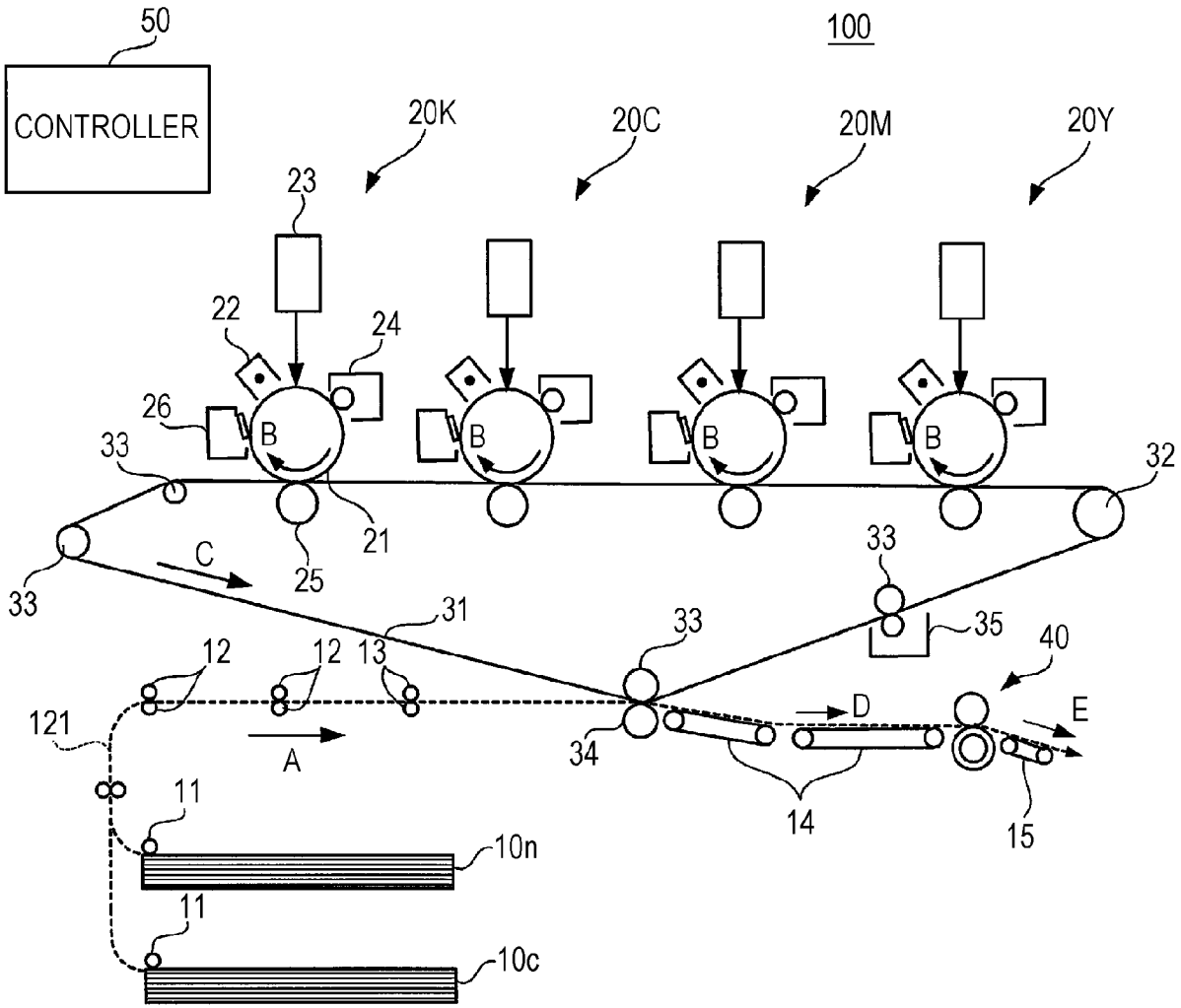
FIG. 1 is a schematic diagram of an image forming apparatus according to an exemplary embodiment of the invention.

FIG. 1 is a schematic diagram of an image forming apparatus according to the exemplary embodiment of the invention.

An image forming apparatus 100 is a color printer that forms toner images using toners of yellow (Y), magenta (M), cyan (C), and black (K). The image forming apparatus 100 is a tandem type printer in which four image forming engines 20Y, 20M, 20C, and 20K each of which forms a toner image of a corresponding one of Y, M, C, and K colors are disposed along a transport direction of a sheet.

The image forming apparatus 100 includes two sheet feed trays 10*n* and 10*c* disposed in a lower portion of the image forming apparatus 100. Normal sheets are accommodated in the sheet feed tray 10*n* in such a manner as to be stacked on top of one another. Coated sheets each of which is coated so as to have a surface smoothness greater than that of a normal sheet are accommodated in the sheet feed tray 10*c* in such a manner as to be stacked on top of one another.

When image formation is performed, a controller 50 that will be described later instructs one of the sheet feed trays to use the sheets accommodated therein. Then, one of the sheets accommodated in the sheet feed tray that has been instructed is fed from the sheet feed tray by a pickup roller 11. The sheet is transported along a transport path 121 by transport rollers 12 in the direction of arrow A. Then, the timing of subsequent transportation of the sheet is adjusted by standby rollers 13, and the sheet is further transported. Transportation of the sheet after the sheet passes through the standby rollers 13 will be described later.

In the image forming apparatus 100, the four image forming engines 20Y, 20M, 20C, and 20K are disposed along the transport direction of the sheet as described above. Each of the image forming engines 20Y, 20M, 20C, and 20K is an engine that forms a toner image using toner of a corresponding one of Y, M, C, and K colors. The four image forming engines 20Y, 20M, 20C, and 20K have the same configuration except for toner to be used. Here, as a representative example of the four image forming engines 20Y, 20M, 20C, and 20K, the configuration of the image forming engine 20K will be described.

The image forming engine 20K includes a photoconductor 21. A charger 22, an exposure unit 23, a developing unit 24, a first transfer unit 25, and a photoconductor cleaner 26 are disposed around the periphery of the photoconductor 21. Here, the first transfer unit 25 is disposed in such a manner that an intermediate transfer belt 31, which will be described later, is nipped between the first transfer unit 25 and the photoconductor 21.

The photoconductor 21 has a cylindrical shape. The surface of the photoconductor 21 is charged and then exposed to light while the photoconductor 21 is rotating in the direction of arrow B, and as a result, an electrostatic latent image is formed on the surface of the photoconductor 21.

The charger 22 charges the photoconductor 21 that is rotating.

Image data is input to the exposure unit 23 from the controller 50, which will be described later, and the exposure unit 23 emits exposure light that is modulated in accordance with the image data, which has been input. The photoconductor 21 is irradiated with the exposure light emitted from the exposure unit 23 after being charged by the charger 22. As a result, an electrostatic latent image is formed on the surface of the photoconductor 21.

After the photoconductor 21 is irradiated with the exposure light, and an electrostatic latent image is formed on the surface of the photoconductor 21, the electrostatic latent image is developed by the developing unit 24, and a toner image is formed on the surface of the photoconductor 21.

The toner image that is formed on the photoconductor 21 by being developed by the developing unit 24 is transferred onto the intermediate transfer belt 31 by operation of the first transfer unit 25.

Residual toner or the like that remains on the surface of the photoconductor 21 after the toner image is transferred is removed from the photoconductor 21 by the photoconductor cleaner 26.

The intermediate transfer belt 31 is an endless belt that is stretched by a driving roller 32 and the other rollers 33 and that circularly moves in the direction of arrow C.

Toner images each of which is formed in one of the image forming engines 20Y, 20M, 20C, and 20K using toner of the corresponding one of Y, M, C, and K colors are transferred onto the intermediate transfer belt 31 in such a manner as to be sequentially superposed with one another with the toner image that is formed in the image forming engine 20Y using the Y toner being the lowermost layer. Then, the toner images are transported to a second transfer position at which a second transfer unit 34 is disposed. The sheet that has been transported to the standby rollers 13 is transported to the second transfer position synchronously with the transportation of the toner images, and the toner images on the intermediate transfer belt 31 are transferred onto the sheet, which has been transported, by operation of the second transfer unit 34. The sheet to which the toner images have been transferred is further transported along a transport belt 14 in the direction of arrow D, and a fixing unit 40 heats the toner images on the sheet and applies pressure to the toner images, so that the toner images are fixed onto the sheet. As a result, an image made of the toner images, which have been fixed to the sheet, is formed on the sheet. The sheet on which the image has been formed is transported in the direction of arrow E by a transport belt 15 and ejected to an area outside the image forming apparatus 100.

After the toner images are transferred to the sheet by the second transfer unit 34, the intermediate transfer belt 31 further circularly moves, and toner that remains on a surface of the intermediate transfer belt 31 is removed from the intermediate transfer belt 31 by a belt cleaner 35.

A combination of the image forming engines 20Y, 20M, 20C, and 20K, the intermediate transfer belt 31, and the second transfer unit 34 corresponds to an example of a toner image forming unit according to the exemplary embodiment of the invention. The fixing unit 40 corresponds to an example of a fixing unit according to the exemplary embodiment of the invention.

The image forming apparatus 100 includes the controller 50. Image data is input to the controller 50. The image data represents a series of images to be formed on one or more sheets. Information that specifies one of a normal sheet and a coated sheet to be used as a sheet on which the series of images represented by the image data is to be formed is attached to the image data. In addition, information that specifies the number of copies of the series of images represented by the image data to be formed is also attached to the image data.

The controller 50 converts the image data into image data that is appropriate for the radiation of the exposure light by the exposure unit 23 of each of the image forming engines 20Y, 20M, 20C, and 20K. The controller 50 transmits the image data, which has been converted, to each of the exposure units 23, and each of the exposure units 23 radiates the exposure light onto the corresponding photoconductor 21 in accordance with the image data that has been input and that corresponds to each of Y, M, C, and K colors.

In addition, the controller 50 instructs one of the two sheet feed trays 10*n* and 10*c*, in which the sheet that is specified by the information attached to the image data is accommodated, to feed the sheet.

As a result, formation of an electrostatic latent image based on the image data and accordingly formation of a toner image based on the image data are performed in each of the image forming engines 20Y, 20M, 20C, and 20K. Then, the toner image is transferred and fixed onto the sheet, which is specified by the information attached to the image data.

Here, a phenomenon called toner scattering that is generally likely to occur when a toner image is transferred to a sheet will now be described, and the image forming apparatus 100 according to the exemplary embodiment will be described later.

Figure 2:
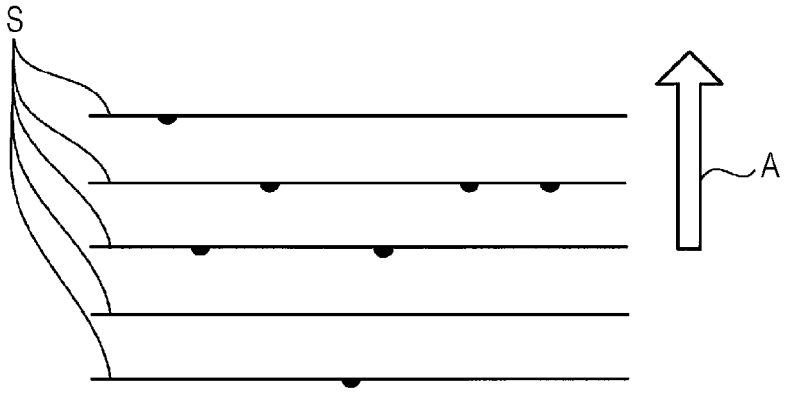
FIG. 2 is a diagram schematically illustrating an image in which a toner scattering phenomenon has occurred.

FIG. 2 is a diagram schematically illustrating an image in which toner scattering has occurred.

FIG. 2 illustrates an image in which lines S are equally spaced in a transport direction of a sheet indicated by arrow A that is also illustrated in FIG. 1.

In the image of FIG. 2, toner is scattered in places on the lines S toward the rear in the transport direction. Such toner scattering reduces image quality.

Figure 3A:
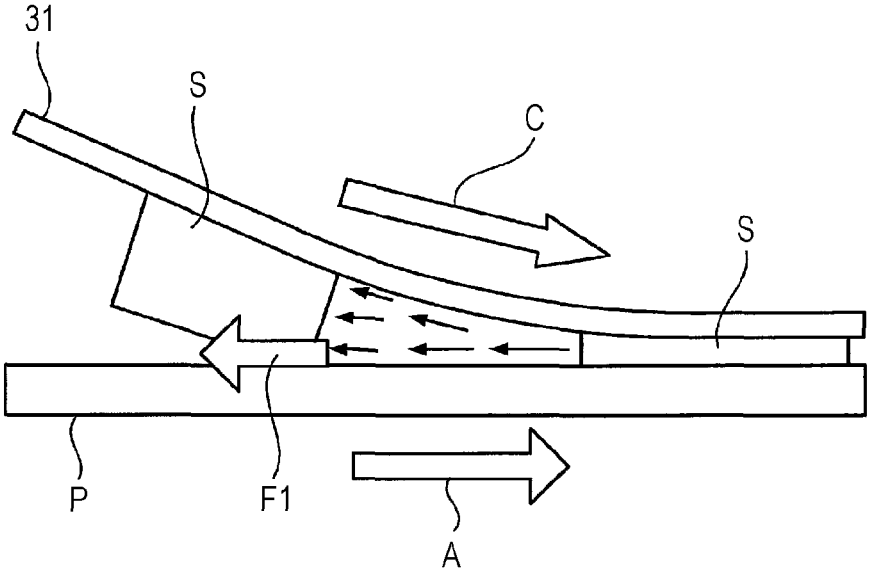
FIGS. 3A and 3B are diagrams describing the mechanism of occurrence of toner scattering.
Figure 3B:
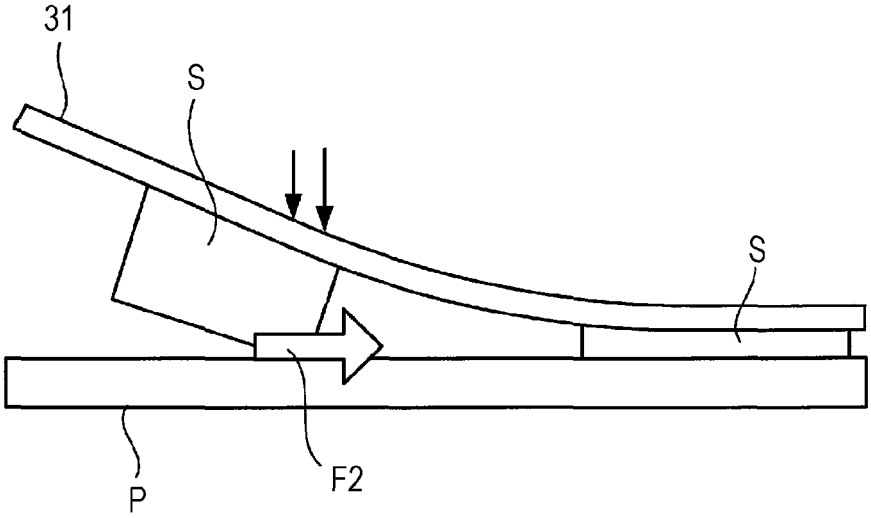

FIGS. 3A and 3B are diagrams describing the mechanism of occurrence of toner scattering.

Note that an element that is the same as the intermediate transfer belt 31 illustrated in FIG. 1 is illustrated in FIGS. 3A and 3B, and the element is denoted by the same reference numeral as used in FIG. 1.

When a toner image such as that shown in FIG. 2 in which the lines S are arranged is transferred from the intermediate transfer belt 31 circularly moving in the direction of arrow C that is also illustrated in FIG. 1 to a sheet P that has been transported in the transport direction indicated by arrow A, the following two forces act on the toner that forms the toner image: a scattering force F1 that tries to cause the toner to be scattered toward the rear in the transport direction and a reaction force F2 that tries to cause the toner to remain at a transfer position on the sheet P against the scattering force F1.

FIG. 3A schematically illustrates the scattering force F1 that is acting on toner, and FIG. 3B schematically illustrates the reaction force F2 that is acting on toner.

As illustrated in FIG. 3A, when the toner image in which the lines S are arranged is transferred, air collects between adjacent lines S. Then, as the intermediate transfer belt 31 is pressed against the sheet P from the front toward the rear in the transport direction of the sheet P (arrow A) when the toner image is transferred, the air flows toward the rear in the transport direction. As a result, the air comes into contact with toner that forms one of the adjacent lines S that is the rear line S in the transport direction, and the scattering force F1 that tries to cause the toner to be scattered toward the rear in the transport direction acts on the toner.

On the other hand, the reaction force F2, which tries to cause the toner to remain at the transfer position on the sheet against the scattering force F1, acts on the toner that forms each of the lines S. The reaction force F2 is a resultant force of a load caused by a pressure that is applied when the toner is transferred, an electrostatic force that is applied when the toner is transferred, and a non-electrostatic force such as an adhesion force of the toner that acts on the intermediate transfer belt 31 or the sheet.

When the above-described scattering force F1 exceeds the reaction force F2, toner scattering in which toner is scattered toward the rear in the transport direction occurs.

Such toner scattering is more likely to occur as, in a toner image, the width of a toner region, in which toner is present, in the transport direction becomes narrower like in the above-described lines, and the width of a non-toner region, which is present in front of the toner region in the transport direction and in which toner is not present, in the transport direction of a sheet becomes narrower.

An image forming speed (a process speed) of the image forming apparatus 100 is a combination of an operating speed of each of the image forming engines 20Y, 20M, 20C, and 20K, a moving speed of the intermediate transfer belt 31, a transport speed of a sheet, and the like, and the larger the process speed, the more toner scattering is likely to occur. This is because a force that causes the air, which causes the above-described scattering force F1, to flow toward the rear in the transport direction of a sheet becomes larger as the process speed becomes larger.

Toner scattering is more likely to occur in the case where a coated sheet is used than in the case where a normal sheet is used. This is because a coated sheet has a surface smoothness greater than that of a normal sheet, and thus, the non-electrostatic force that is one of the above-mentioned three forces included in the reaction force F2 is reduced.

The phenomenon called toner scattering has been described above, and description of this phenomenon has been completed. The description will now return to the image forming apparatus 100 according to the exemplary embodiment.

In the image forming apparatus 100 according to the exemplary embodiment illustrated in FIG. 1, the controller 50 performs an analysis that will be described later on image data that is input to the controller 50 and determines whether or not a toner image that is to be formed on the basis of the image data is a scattering toner image that leads to toner scattering. In addition, the controller 50 determines whether or not a sheet that is specified by information attached to the image data, which has been input to the controller 50, is a coated sheet.

Then, the controller 50 controls the process speed in image formation based on the image data, which has been input, in accordance with a result of the determination.

The controller 50 will be described below focusing on a function thereof that controls the process speed.

Figure 4:
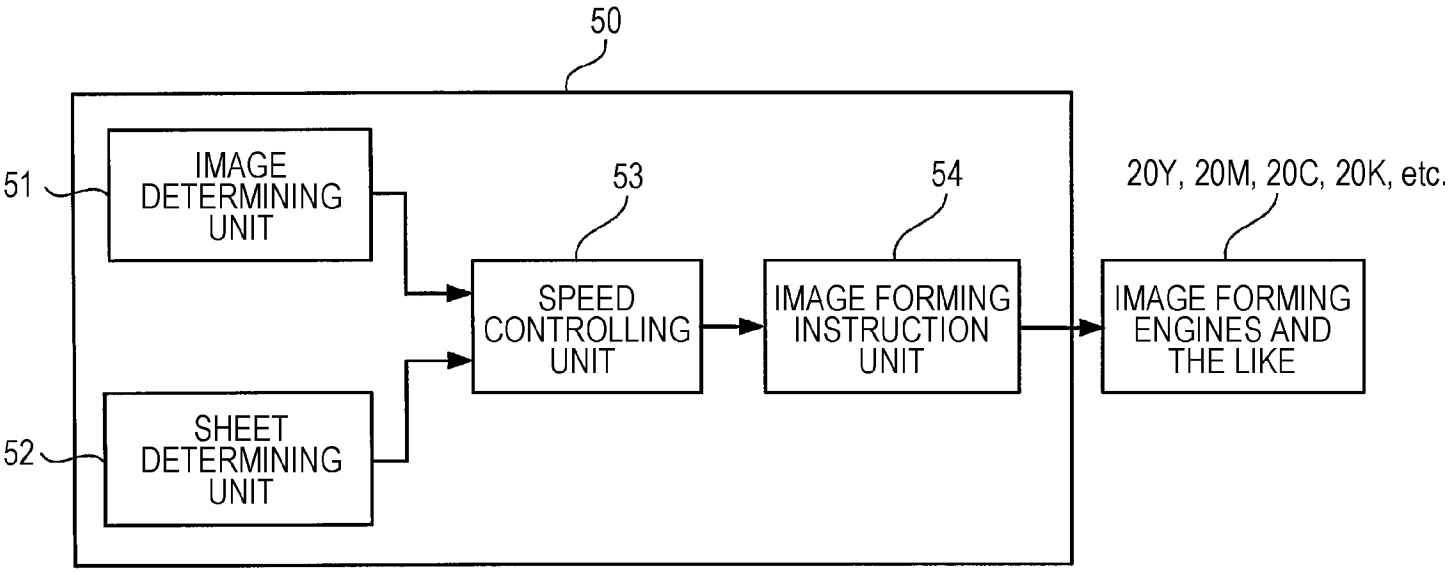
FIG. 4 is a functional block diagram of a process speed setting function of a controller that is illustrated in FIG. 1.

FIG. 4 is a functional block diagram illustrated so as to focus on the function of the controller 50 illustrated in FIG. 1 that controls the process speed.

The controller 50 includes an image determining unit 51, a sheet determining unit 52, a speed controlling unit 53, and an image forming instruction unit 54.

The image determining unit 51 determines whether or not a toner image that is to be formed on the basis of image data that is input to the controller 50 is a scattering toner image. The details of the determination will be described later. The image determining unit 51 corresponds to an example of an image determining unit according to the exemplary embodiment of the invention.

The sheet determining unit 52 determines whether or not a sheet that is specified by information attached to the image data, which has been input to the controller 50, is a coated sheet. The sheet determining unit 52 corresponds to an example of a sheet determining unit according to the exemplary embodiment of the invention.

The speed controlling unit 53 sets the process speed in accordance with results of the determinations made by the image determining unit 51 and the sheet determining unit 52. The details of the setting of the process speed will be also described later. The speed controlling unit 53 corresponds to an example of a speed controlling unit according to the exemplary embodiment of the invention.

The image forming instruction unit 54 causes each of the image forming engines 20Y, 20M, 20C, and 20K and the intermediate transfer belt 31 to operate in accordance with the process speed, which has been set by the speed controlling unit 53, and to perform image formation based on the image data, which has been input to the controller 50.

Figure 5:
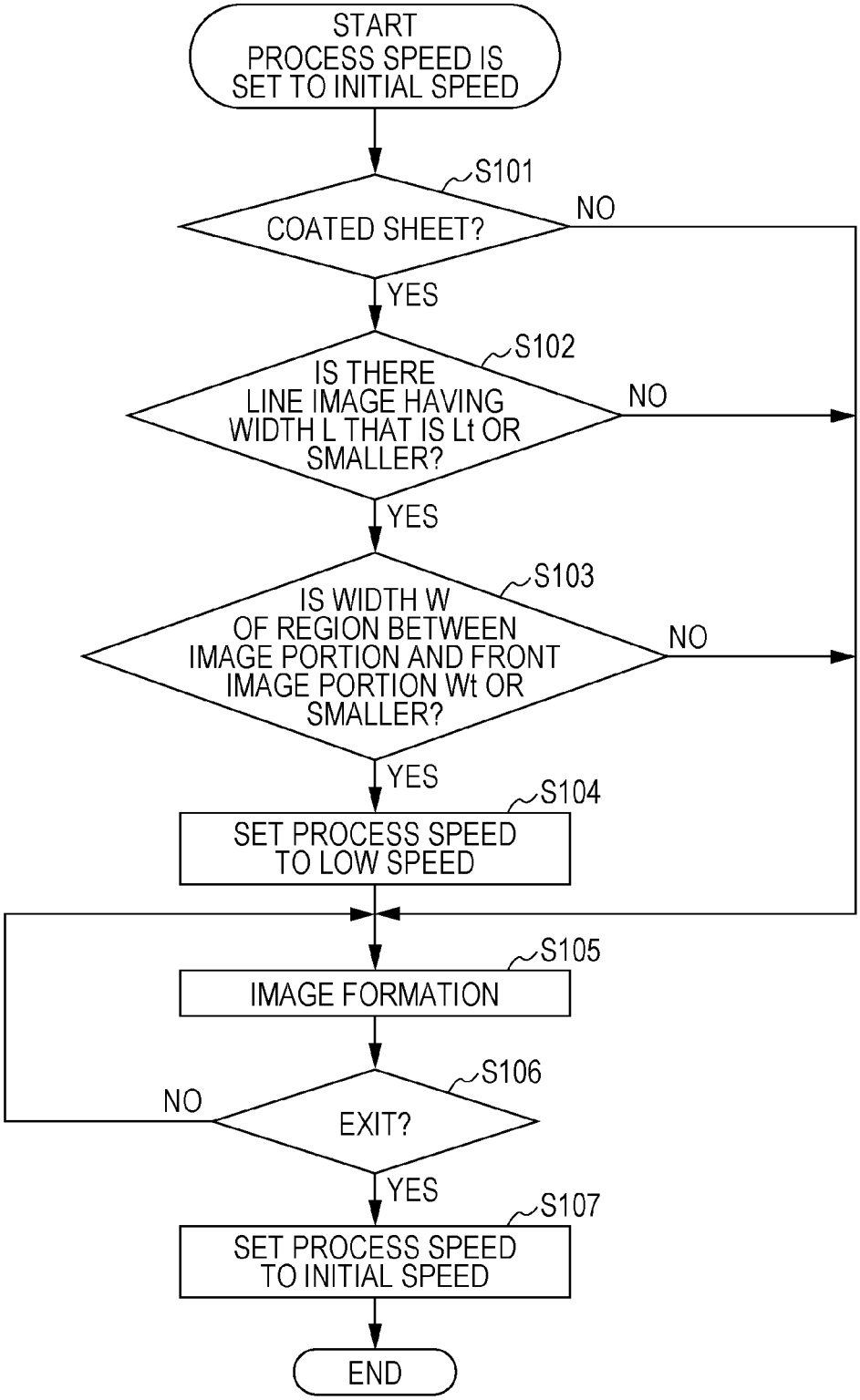
FIG. 5 is a flowchart illustrating the flow of a process of setting a process speed that is performed by the controller.

FIG. 5 is a flowchart illustrating a flow of a process of setting the process speed that is performed by the controller 50.

The process illustrated by the flowchart starts when image data is transmitted from the outside to the image forming apparatus 100. Note that, in the exemplary embodiment, the process speed is set to a predetermined initial speed by the speed controlling unit 53 at the start of the process.

First, once the process starts, the sheet determining unit 52 determines whether or not the sheet that is specified by the information attached to the image data, which has been input, is a coated sheet (step S101). In step S101, in this case, it is determined whether or not a sheet to which toner is to be transferred is a coated sheet on which toner scattering is likely to occur.

In the case where it is determined that the sheet is a coated sheet (Yes in step S101), the image determining unit 51 makes the following determination.

In this case, the image determining unit 51 determines whether or not a toner region having a width L that is less than or equal to a predetermined reference width Lt in the transport direction of the sheet is present in an image represented by the image data, which has been input (step S102).

In the case where it is determined that the toner region having the width L that is less than or equal to the reference width Lt is present (Yes in step S102), the image determining unit 51 further makes the following determination.

In this case, the image determining unit 51 determines whether or not the width W of a non-toner region, which is present in front of the toner region in the transport direction of the sheet, in the transport direction, is less than or equal to a predetermined reference width Wt (step S103).

In step S102 and step S103, it is determined whether or not a toner image that is formed in this case is a scattering toner image that causes occurrence of toner scattering.

In the case where it is determined that the width W is less than or equal to the reference width Wt (Yes in step S103), the speed controlling unit 53 sets the process speed to a low speed that is lower than the initial speed and at which occurrence of toner scattering is suppressed (step S104).

Then, the image forming instruction unit 54 causes each of the image forming engines 20Y, 20M, 20C, and 20K and the intermediate transfer belt 31 to operate in accordance with the process speed, which has been set, and to perform image formation based on the image data, which has been input to the controller 50 (step S105).

When the process of step S105 is performed after the process of step S104 is performed, occurrence of toner scattering at the time of transferring toner onto the sheet is suppressed in the case where the process speed is the initial speed, and an image of high image quality is formed on the sheet.

Here, in the case where it is determined that the sheet is a normal sheet in step S101 (No in step S101), the processes of step S102 to step S104 are omitted. Then, the process moves on to step S105, and image formation at the initial speed is performed.

In addition, in the case where it is determined in step S102 that the toner region having the width L that is less than or equal to the reference width Lt is not present (No in step S102), the process also moves on to step S105, and image formation at the initial speed is performed.

Furthermore, in the case where it is determined that the width W of the non-toner region is not less than or equal to the reference width Wt in step S103 (No in step S103), the process also moves on to step S105, and image formation at the initial speed is performed.

As described above, in the exemplary embodiment, in the case where toner is transferred onto a normal sheet on which toner scattering is not likely to occur and in the case where a toner image is not a scattering toner image, image formation at the initial speed is performed, and productivity in image formation is improved.

Every time an image is formed on one sheet, the image forming instruction unit 54 determines whether or not all of a series of images represented by the image data, which has been input, have been formed for the number of copies specified by the information attached to the image data (step S106).

In the case where it is determined that all of the series of images have not been formed for the number of copies (No in step S106), the process returns to step S105, and image formation continues.

On the other hand, in the case where it is determined that all of the series of images have been formed for the number of copies (Yes in step S106), the speed controlling unit 53 sets the process speed to the initial speed (step S107). In the case where the process speed has been set to the low speed in step S104, the process speed is reset to the initial speed in step S107. In the case where image formation has been performed while the process speed remained unchanged from the initial speed, the process speed is maintained at the initial speed in step S107. The process of step S107 allows the process illustrated by the flowchart to start at the process speed that has been set to the initial speed when next image data is input. The process illustrated by the flowchart is exited after the process of step S107 is performed.

Note that, in the exemplary embodiment, as an example of the speed controlling unit according to the exemplary embodiment of the invention, the speed controlling unit 53 that sets the process speed to the low speed in the case where the sheet is a smooth sheet that is represented by a coated sheet, and in the case where the toner image that is to be formed on the basis of the image data, which has been input, is a scattering toner image has been described. However, the speed controlling unit according to the exemplary embodiment of the invention is not limited to the speed controlling unit 53. The speed controlling unit according to the exemplary embodiment of the invention may be, for example, a speed controlling unit that sets the process speed to the low speed regardless of the type of sheet in the case where a toner image that is to be formed on the basis of the image data, which has been input, is a scattering toner image.

In the exemplary embodiment, as an example of the image determining unit according to the exemplary embodiment of the invention, the image determining unit 51 that determines whether or not the toner image that is to be formed on the basis of the image data, which has been input, is a scattering toner image by analyzing the image data, which has been input, has been described. However, the image determining unit according to the exemplary embodiment of the invention is not limited to the image determining unit 51. The image determining unit according to the exemplary embodiment of the invention may be, for example, an image determining unit that makes the above-described determination by capturing a toner image formed on the intermediate transfer belt 31 using a charge-coupled device (CCD) and analyzing the captured image.

In the exemplary embodiment, a tandem type color printer has been described as an example of the image forming apparatus according to the exemplary embodiment of the invention. However, the image forming apparatus according to the exemplary embodiment of the invention may be, for example, a rotary type color printer rather than a tandem type color printer or may be a black-and-white printer rather than a color printer or the like. In addition, the image forming apparatus according to the exemplary embodiment of the invention may be, for example, a copying machine, a facsimile machine, or the like rather than a printer.

The present invention will now be further described on the basis of examples corresponding to the above-described exemplary embodiment. However, the present invention is no way limited to the following examples. In addition, the present invention will be further described below with reference to a comparative example compared with the examples as necessary.

FIRST EXAMPLE

A modified printer Color 1000 Press manufactured by Fuji Xerox Co., Ltd. is used as an image forming apparatus, and the image forming apparatus is provided with a function that performs the above-described process illustrated by the flowchart of FIG. 5.

In a first example, the above-mentioned reference width Lt is 2 mm, which corresponds to 8 dots, and the reference width Wt is 5 mm.

In addition, in the first example, the above-mentioned initial speed is 120 sheets/minute, and the low speed is two-thirds of the initial speed.

In the first example, in a high temperature, high humidity environment with a temperature of 28° C. and a humidity of 85%, an image in which lines each having a width of 0.5 mm in a subscanning direction that corresponds to a transport direction of a sheet are spaced at a pitch of 2.5 mm in the subscanning direction is formed on an A3 coated sheet. The degree of occurrence of toner scattering in the image, which is formed, is evaluated by visual observation.

SECOND EXAMPLE

In a second example, an image is formed under the same conditions as in the above-described first example except that the low speed is one-half of the initial speed, and the degree of occurrence of toner scattering in the image is evaluated by visual observation.

THIRD EXAMPLE

In a third example, an image is formed under the same conditions as in the above-described first example except that the low speed is one-third of the initial speed, and the degree of occurrence of toner scattering in the image is evaluated by visual observation.

COMPARATIVE EXAMPLE

In the comparative example that is to be compared with the above-described first to third examples, an image is formed under the same conditions as in the above-described first example except that the process speed is constantly the same as the above-mentioned initial speed, and the degree of occurrence of toner scattering in the image is evaluated by visual observation.

Results of the evaluations with respect to toner scattering performed in the above-described comparative example and the above-described first to third examples are shown in Table 1 below.

TABLE 1

| | Speed Reduction | Line Width | Interval Between Lines | Scattering Grade |
|---|---|---|---|---|
| Comparative Example | None (120 ppm) | 8 dots | 2.5 mm | C |
| First Example | ⅔ Speed | 8 dots | 2.5 mm | B |
| Second Example | Half Speed | 8 dots | 2.5 mm | A |
| Third Example | ⅓ Speed | 8 dots | 2.5 mm | A |

First, toner scattering is observed at multiple locations in the image that is formed in the comparative example, and the evaluation result obtained in the comparative example is represented by C in Table 1.

Toner scattering is observed in the image that is formed in the first example. However, the degree of occurrence of toner scattering in the image is reduced compared with the degree of occurrence of toner scattering in the image that is formed in the comparative example, and the evaluation result obtained in the first example is represented by B in Table 1.

The degree of occurrence of toner scattering in both the images that are formed in the second example and in the third example are further reduced compared with the degree of occurrence of toner scattering in the image that is formed in the first example, and each of the evaluation results obtained in the second examples and in the third examples is represented by A in Table 1.

It is understood from Table 1 that the degree of occurrence of toner scattering is reduced by reducing the process speed, and in addition, the degree of reduction in the degree of occurrence of toner scattering increases as the process speed becomes slower.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a toner image forming unit configured to form a toner image using image data, and configured to transfer the toner image onto a sheet, from a front end of the sheet to a rear end of the sheet in a transport direction of the sheet as the sheet is transported;

a fixing unit that is positioned downstream from the toner image forming unit in the transport direction of the sheet and that is configured to fix the toner image, which has been transferred to the sheet by the toner image forming unit, onto the sheet;

an image determining unit configured to determine whether or not the toner image that is formed by the toner image forming unit is a scattering toner image that is likely to cause scattering of toner when the toner image is transferred to the sheet; and a speed controlling unit configured to control, in response to the image determining unit determining that the toner image is a scattering toner image, a transport speed at which the sheet is transported by the toner image forming unit and a transfer speed at which the toner image is transferred to the sheet to be slower than the transport speed and the transfer speed controlled in response to the image determining unit determining that the toner image is not a scattering toner image.

2. The image forming apparatus according to claim 1, wherein the image determining unit is configured to determine that the toner image is a scattering toner image in response to analyzing the image data and determining that the toner image that is to be formed is divided into a toner region, in which the toner is to be transferred onto the sheet, and a non-toner region, in which the toner is not to be transferred to the sheet, the non-toner region having a width less than or equal to a predetermined reference width in the transport direction of the sheet, the toner region having a width less than or equal to a predetermined reference width in the transport direction of the sheet, and the toner region being subsequent to the non-toner region on the rear end side of the sheet in the transport direction of the sheet.

3. The image forming apparatus according to claim 1, wherein the image determining unit is configured to determine that the toner image is a scattering toner image in response to determining that the sheet is a coated sheet.

4. An image forming apparatus comprising:

a toner image forming unit configured to form a toner image using image data and configured to transfer the toner image onto a sheet from a front end of the sheet to a rear end of the sheet in a transport direction of the sheet as the sheet is transported;

a fixing unit that is positioned downstream from the toner image forming unit in the transport direction of the sheet and that is configured to fix the toner image, which has been transferred to the sheet by the toner image forming unit, onto the sheet; and a speed controlling unit configured to control a transport speed, at which the sheet is transported by the toner image forming unit, to be a slower speed in response to the toner image that is formed by the toner image forming unit being a scattering toner image.

* * * * *